US006772899B2

(12) United States Patent
Delmon

(10) Patent No.: US 6,772,899 B2
(45) Date of Patent: Aug. 10, 2004

(54) CASE WITH INVISIBLE ARTICULATION MEANS

(75) Inventor: Marc Delmon, Le Bex d'Ytrac (FR)

(73) Assignee: Qualipac, Neuilly-sur-Seine (FR)

( * ) Notice: Subject to any disclaimer, the term of this patent is extended or adjusted under 35 U.S.C. 154(b) by 0 days.

(21) Appl. No.: 09/902,631

(22) Filed: Jul. 12, 2001

(65) Prior Publication Data

US 2002/0014493 A1 Feb. 7, 2002

(30) Foreign Application Priority Data

Aug. 4, 2000 (FR) ..... 00 10329

(51) Int. Cl.[7] ..... B65D 43/26

(52) U.S. Cl. ..... 220/263; 220/812; 220/836; 132/295

(58) Field of Search ..... 220/263, 324, 220/811–813, 836, 847, 843, 840, FOR 193, FOR 192, FOR 201, FOR 183; 132/295, 294; 206/823, 581, 45.2, 235; 16/266, 261, 262, 267

(56) References Cited

U.S. PATENT DOCUMENTS

| | | | | | |
|---|---|---|---|---|---|
| 1,377,526 | A | * | 5/1921 | Rust | 220/811 |
| 2,415,357 | A | | 2/1947 | Kucki | |
| 2,547,353 | A | * | 4/1951 | Winikka | 220/813 |
| 2,850,760 | A | * | 9/1958 | Vanderwalker | 220/812 |
| 3,093,263 | A | * | 6/1963 | Mabry | 220/812 |
| 3,682,348 | A | | 8/1972 | Roberts | |
| 3,995,764 | A | * | 12/1976 | Zagami | 220/263 |
| 4,746,031 | A | | 5/1988 | Grandmottet | |
| 5,898,132 | A | * | 4/1999 | Lee | 16/266 |
| 6,129,237 | A | * | 10/2000 | Miyahara | 220/255 |

FOREIGN PATENT DOCUMENTS

| | | | | |
|---|---|---|---|---|
| CA | 774424 | * | 12/1967 | 220/FOR 193 |
| EP | 250310 A2 | * | 12/1987 | |
| FR | 34397 | * | 6/1929 | 220/FOR 189 |
| GB | 690505 | * | 4/1953 | 220/FOR 189 |
| GB | 900552 | * | 7/1962 | 220/FOR 195 |

* cited by examiner

*Primary Examiner*—Robin A. Hylton
(74) *Attorney, Agent, or Firm*—Rothwell, Figg, Ernst & Manbeck

(57) ABSTRACT

A case essentially comprising a base, a lid and articulation means for articulating the lid with respect to the base. The articulation means have a pin and a seating in which the pin pivots in a direction of rotation, in order to articulate the lid with respect to the base between a closed position in which the articulation means are concealed on the inside of the case and an open position. The seating extends in a direction of slide substantially perpendicular to the direction of rotation to further permit translation of the lid in the direction of slide and the device further comprises means for combining the movements of rotation and of translation of the lid.

10 Claims, 4 Drawing Sheets

CASE WITH INVISIBLE ARTICULATION MEANS

BACKGROUND OF THE INVENTION

The invention relates to a case, in particular intended to contain a cosmetic product.

More precisely, the invention relates to a case essentially comprising a base, a lid and articulation means for articulating the lid with respect to the base between a closed position in which it comes into contact with the base and an open position in which it is substantially away from the base.

It aims to provide an articulation the means of which are concealed on the inside of the case, between the base and the lid, and consequently invisible when the lid is in the closed position.

EP-A-0 250 310 describes such a case. The articulation means have a first and a second part linked one to the lid and the other to the base. The first part comprises a pin and the second part a seating in which said pin pivots in a direction of rotation, in order to articulate the lid with respect to the base between the closed position and the open position.

However, this rotary hinge requires radial openings to be provided in the case in order to permit the passage of arms connecting the lid to the pin. Moreover, it is relatively bulky and scarcely makes it possible to obtain an angle of rotation of much more than 90 degrees.

SUMMARY OF THE INVENTION

In order to remedy these drawbacks, the invention proposes that:

said seating extends in a direction of slide substantially perpendicular to the direction of rotation to further permit translation between the first part and the second part of the articulation means in said direction of slide, and the device further comprises means for combining the rotation and the translation of the first part of the articulation means with respect to the second part of the articulation means.

The displacement of the pin inside the seating allows the angle of opening to be increased while reducing the opening in the base and the bulk of the articulation means. The combination of the rotational and translational movements facilitates the operations of opening and closing the lid.

According to an advantageous feature, the invention proposes that:

the first part of the articulation means further comprises a tongue having an arc shape and the pin is offset with respect to the centre of curvature of the arc, the second part of the articulation means further comprises guide means co-operating with said tongue to combine the rotation and the translation of the first part of the articulation means with respect to the second part of the articulation means between the closed position and the open position of the lid.

The angle of opening can thus be increased and the bulk of the articulation means reduced.

An interesting embodiment proposed by the invention consists in that:

the pin is connected to the lid by way of the tongue, and the guide means comprise a slot provided in the receptacle, in which the tongue slides.

As a complement thereto, in order to permit easy production and in particular easy assembly of the case, as well as satisfactory operation, the invention proposes that:

the slot and the tongue are substantially of the same width, the tongue is connected to the pin by a connecting portion defining a neck, narrower than the tongue, the slot is interrupted in a central portion by a recess, said recess having a width which is less than that of the slot providing two end portions of the slot, but greater than that of the neck, in order to permit the insertion of the tongue into the slot.

In order to improve further the ratio of bulk to angle of opening, the invention proposes that the arc defined in section by the tongue has a variable radius of curvature.

An advantageous embodiment having this feature consists in that the tongue has in section a portion in the shape of an arc of a circle connected to a substantially straight portion arranged in proximity to the pin.

In order to facilitate further the use of the case, the invention proposes that the dimensions of the seating are adapted to those of the pin to create friction between the pin and its seating and thus hold the lid in position with respect to the base.

Thus, the lid is not likely to close again by itself during use.

In order to further reduce the bulk of the articulation means, the invention proposes that the base comprises two elements defining a bottom and a product receptacle between which said seating is provided.

BRIEF DESCRIPTION OF THE DRAWINGS

The invention will become even clearer from the following description, provided with reference to the appended drawings, in which.

DETAILED DESCRIPTION

Figure 1:
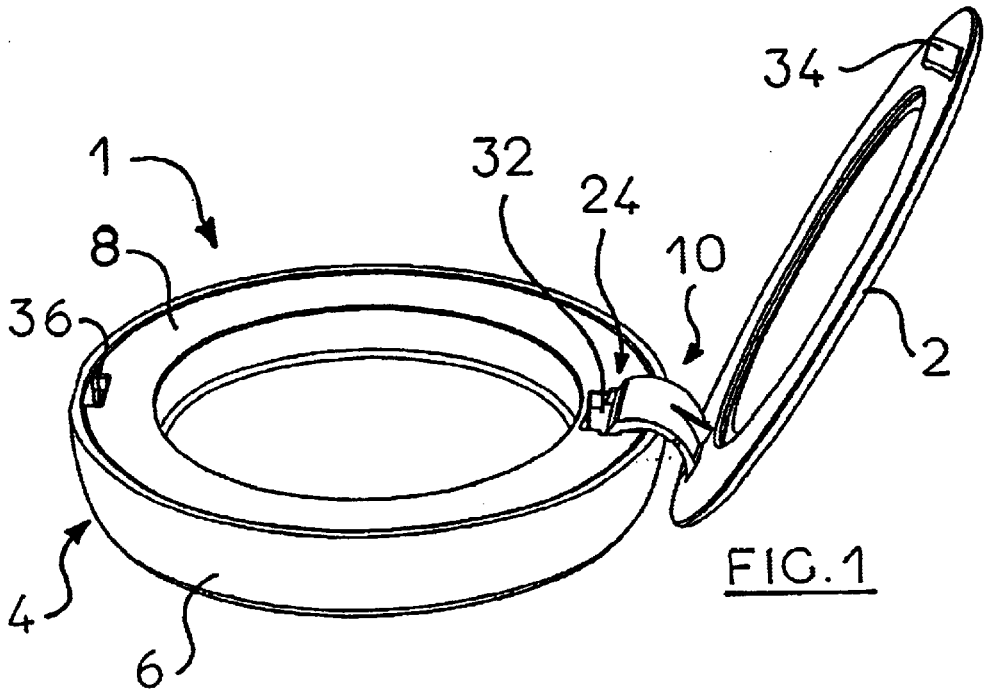
FIG. 1 is a perspective view of a case according to the invention, in the open position.

The drawings illustrate a case 1 comprising a lid 2 articulated with respect to a base 4. The base comprises a bottom 6 and an inner element 8 arranged inside the bottom 6 to receive cosmetic products.

The bottom 6 has a peripheral rib 38 which is inserted into a groove 40 provided in the receptacle, so that the receptacle 8 is retained by interlocking with respect to the bottom.

Figure 2:
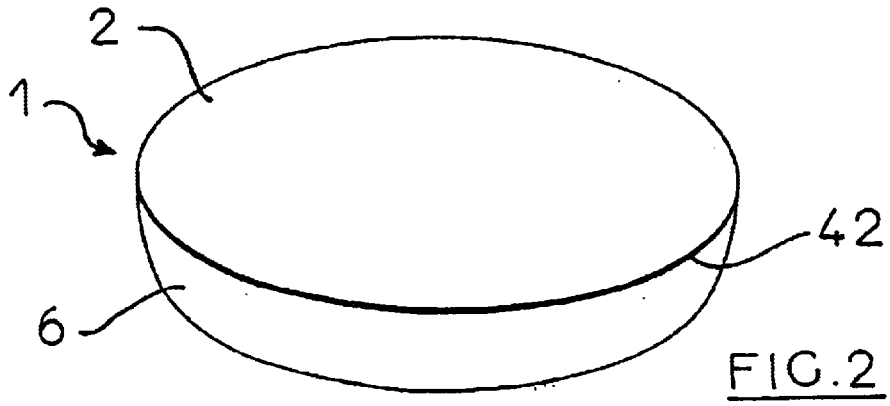
FIG. 2 is a perspective view of the case, in the closed position.
Figure 3:
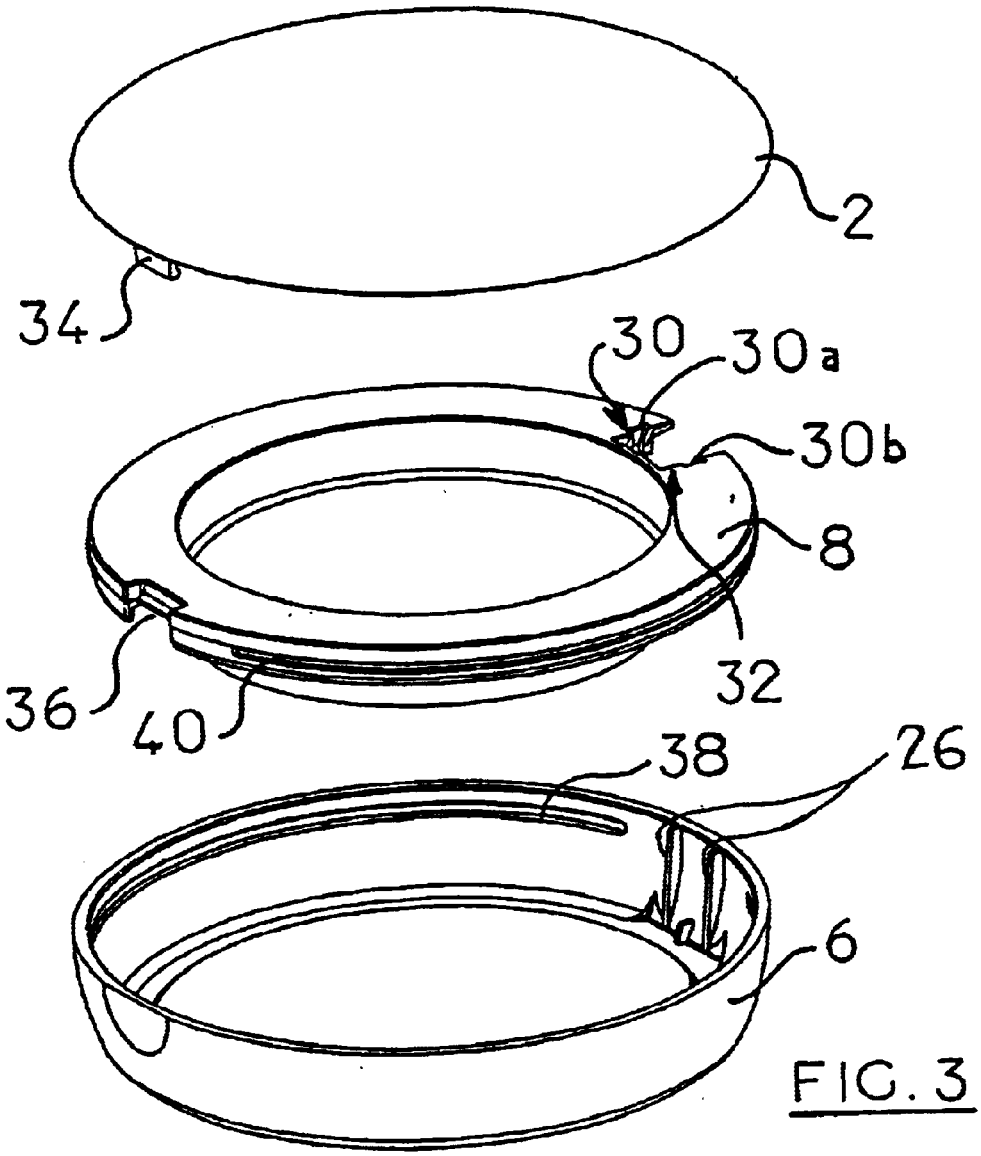
FIG. 3 is an exploded perspective view of the case.
Figure 4:
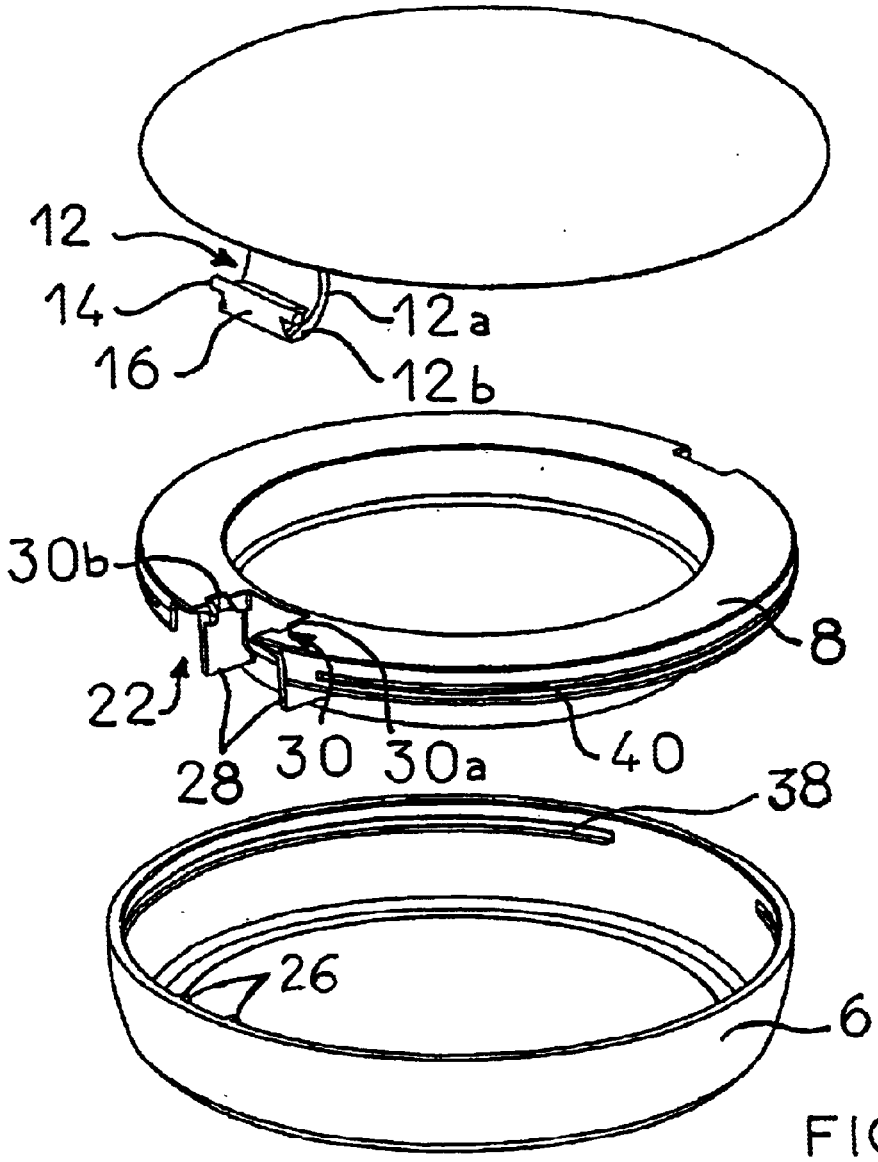
FIG. 4 is another exploded perspective view of the case.
Figure 5:
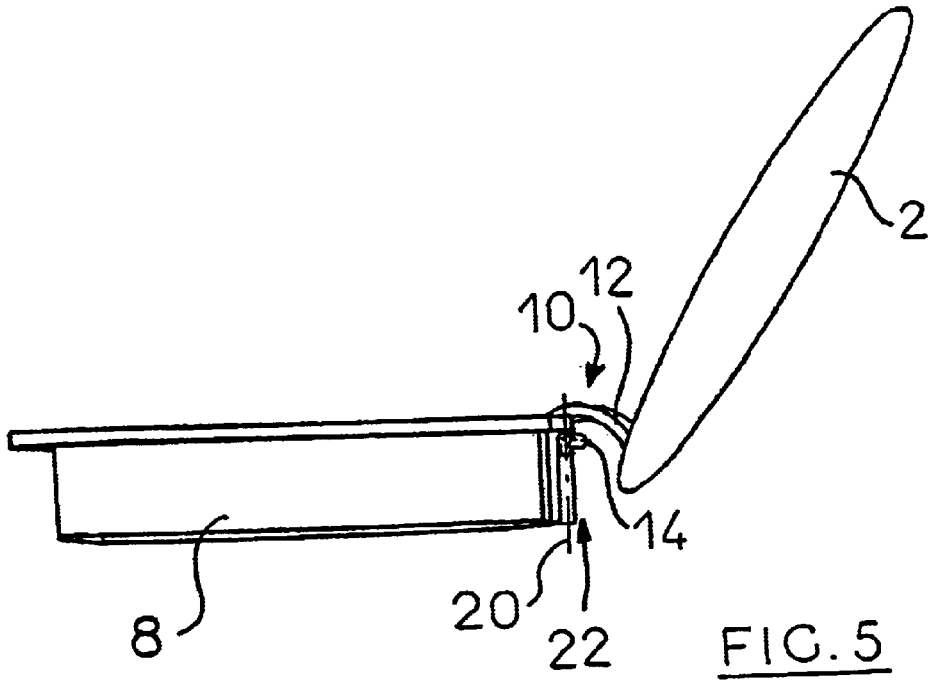
FIG. 5 is a perspective view of the case, in the open position, without the bottom.
Figure 6:
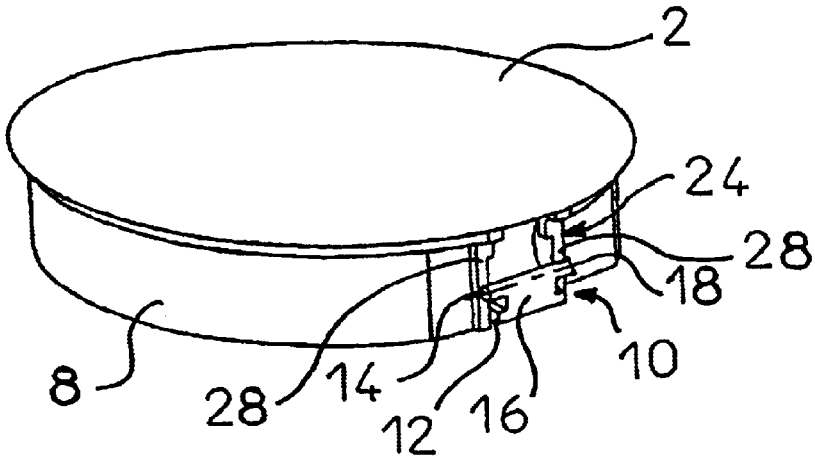
FIG. 6 is a perspective view of the case, in the closed position, without the bottom.

The case further comprises articulation means 10 for articulating the lid 2 with respect to the base 4 between the closed position shown in FIGS. 2 and 6 and the open position shown in FIGS. 1 and 5.

The articulation means comprise a first part integral with the lid and a second part integral with the bottom 6. The first part has a tongue 12 linked directly to the lid, a pin 14 extending in a direction of rotation 18 and a connecting portion 16 connecting the tongue 12 to the pin 14. The second part has a seating 22 extending in a substantially vertical direction of slide 20 and guide means 24.

The bottom 6 has ribs 26 extending in the direction of slide 20. Similarly, the receptacle 8 has ribs 28 extending in the direction of slide 20 substantially opposite the ribs 26 of the bottom 6. The pin 14 bears on the ribs 26, 28 of the bottom 6 and of the receptacle 8 defining the seating 22. The distance between the ribs 26, 28 is slightly less than the diameter of the pin in order to create friction allowing the lid to be held in position.

The guide means 24 comprise a slot 30 interrupted in its central part by a recess 32 narrower than the slot, such that it provides two end portions 30*a*, 30*b*. The slot 30 is offset with respect to the direction of slide 20, such that it does not lie in extension of the seating 22. It extends in a direction which is not parallel to the direction of slide and is moreover substantially curved, in order to improve the guiding of the tongue 12 being inserted inside each of the end portions 30*a*, 30*b*.

The tongue 12 has in section an arc shape having a variable radius of curvature. It comprises in proximity to the lid a first portion 12*a* having in section substantially the shape of an arc of a circle and a second, substantially straight portion 12*b* in proximity to the pin 14. The second plane portion 12*b* comes opposite the bottom, substantially in contact therewith, when the case is in the closed position.

The connecting portion 16, narrower than the tongue 12, defines a neck which is also narrower than the recess 32 in order to permit the insertion of the tongue 12 inside the slot 30.

The case further comprises means for locking in the closed position, comprising a resilient hook 34, linked to the lid, and a slit 36, provided in the base 4, co-operating together and resiliently releasable.

The articulation means 10 allow the lid 2 to be moved between a closed position illustrated in FIG. 2 and an open position illustrated in FIG. 1.

In the closed position, the lid 2 comes into contact with the base 4 on a substantially horizontal contact surface 42. During the opening of the lid 2 towards the open position, in which the lid is substantially away from the base 4, the guide means 24 combine the movements of rotation and translation of the lid 2 with respect to the base 4, in order to open the lid 2 by rotation and to move it away simultaneously from the base 4 by translation. The translation of the pin 14 in the direction of slide 20 is substantially perpendicular to the contact surface 42, or at least it has a non zero component in a direction perpendicular to the contact surface 42.

The bottom and the lid will advantageously be produced in a styrene material, such as acrylonitrile butadiene styrene (ABS), styrene acrylonitrile (SAN), polymethyl methacrylate (PMMA), polyester (PCTA/PCTG), polyamide (PA), polyacetal (POM) or polypropylene (PP).

It is understood that the drawings are provided only by way of non-limiting example.

What is claimed is:

1. A case, in particular intended to contain a cosmetic product, essentially comprising:

a base, a lid, articulation means having a first and a second part which are linked one to the lid and the other to the base, the first part comprising a pin and the second part a seating in which said pin pivots in a direction of rotation, in order to articulate the lid with respect to the base between a closed position in which it comes into contact with the base and an open position in which it is substantially away from the base, said articulation means being concealed on the inside of the case, between the base and the lid, in the closed position of the case, wherein:

said seating extends in a direction of slide substantially perpendicular to the direction of rotation in order further to permit translation between the first part and the second part of the articulation means in said direction of slide, and the case further comprises means for combining the rotation and the translation of the first part of the articulation means with respect to the second part of the articulation means.

2. A case according to claim 1, wherein:

the first part of the articulation means further comprises a tongue having an arc shape and the pin is offset with respect to the centre of curvature of the arc shape, the means for combining the rotation and the translation of the first part of the articulation means with respect to the second part of the articulation means comprises guide means co-operating with said tongue to combine the rotation and the translation of the first part of the articulation means with respect to the second part of the articulation means between the closed position and the open position of the lid.

3. A case according to claim 2, wherein:

the pin is connected to the lid by way of the tongue, and the guide means comprises a slot provided in the receptacle, in which said tongue slides.

4. A case according to claim 3, wherein:

the slot and the tongue are substantially of the same width, the tongue is connected to the pin by a connecting portion defining a neck, narrower than the tongue, the slot is interrupted in a central portion by a recess, said recess having a width less than that of the slot to provide two end portions of the slot, but greater than that of the neck, in order to permit the insertion of the tongue into the slot.

5. A case according to claim 3, wherein the direction of slide is offset with respect to the slot.

6. A case according to claim 2, wherein the arc shape defined in section by the tongue has a variable radius of curvature.

7. A case according to claim 6, wherein the tongue has in section a portion in the shape of an arc of a circle connected to a substantially straight portion arranged in proximity to the pin.

8. A case according to claim 1, wherein the lid comes into contact with the base on a contact surface to which the direction of slide is substantially perpendicular.

9. A case according to claim 1, wherein the pin is frictionally disposed in the seating to hold the lid in a position with respect to the base.

10. A case according to claim 1, wherein the base comprises two elements defining a bottom and a product receptacle between which said seating is provided.

* * * * *